US007219611B1

(12) United States Patent
Troncoso et al.

(10) Patent No.: US 7,219,611 B1
(45) Date of Patent: May 22, 2007

(54) SEWING MACHINE EMBROIDERY THREAD GUIDE

(76) Inventors: Eva G. Troncoso, 16990 Wildwood Dr., Montrose, CO (US) 81401-9604; Freddie Troncoso, 16990 Wildwood Dr., Montrose, CO (US) 81401-9604

( * ) Notice: Subject to any disclaimer, the term of this patent is extended or adjusted under 35 U.S.C. 154(b) by 0 days.

(21) Appl. No.: 10/980,362

(22) Filed: Nov. 3, 2004

(51) Int. Cl.
*D05C 3/00* (2006.01)

(52) U.S. Cl. ..... 112/78; 112/302

(58) Field of Classification Search ..... 112/78, 112/241, 247, 254, 302, 279; 242/125, 125.3, 242/128, 129.7, 137.1, 140
See application file for complete search history.

(56) References Cited

U.S. PATENT DOCUMENTS

| | | | | | |
|---|---|---|---|---|---|
| 69,101 | A | * | 9/1867 | Kershaw | 242/128 |
| 223,133 | A | * | 12/1879 | Hall, Jr. | 242/128 |
| 349,446 | A | * | 9/1886 | Neuhaus | 242/140 |
| 438,854 | A | * | 10/1890 | Miller | 242/134 |
| 444,208 | A | * | 1/1891 | Clark | 242/139 |
| 899,451 | A | * | 9/1908 | Knapp | 242/140 |
| 1,001,718 | A | * | 8/1911 | West | 242/129.8 |
| 1,430,165 | A | * | 9/1922 | Heindrich et al. | 242/140 |
| 1,826,491 | A | * | 10/1931 | Allan | 242/128 |
| 2,508,887 | A | * | 5/1950 | Orrigo | 112/254 |
| 2,528,171 | A | * | 10/1950 | Pehlivanian | 112/302 |
| 2,592,318 | A | * | 4/1952 | Muecke | 242/129.7 |
| 5,842,655 | A | * | 12/1998 | McCarthy | 242/129 |

* cited by examiner

*Primary Examiner*—Danny Worrell
(74) *Attorney, Agent, or Firm*—Donald W. Meeker

(57) ABSTRACT

A bent embroidery thread guide wire is attached to a base mount releasably attachable to a spool pin rod of an embroidery and sewing machine. An open spiral bent loop end of the upwardly bent wire adjusts to a position spaced slightly apart from and approximately centered on an embroidery thread spool mounted on the machine. The embroidery thread feeds from the spool through the open looped end, through the normal threading procedure of the machine, to the thread consuming needle apparatus under tension. A transverse bar extending from the base mount allows the guide wire to slide adjustably thereon to move toward or away from the spool. A stepped base mount receives embroidery thread spools of different diameters.

23 Claims, 4 Drawing Sheets

SEWING MACHINE EMBROIDERY THREAD GUIDE

BACKGROUND OF THE INVENTION

1. Field of the Invention

The present invention relates to an improved thread guide for home embroidery and sewing machines and equipment, and more particularly, to an improved thread guide for the purpose of preventing undesirable unraveling and tangling of the thread which occurs while sewing and doing embroidery work with slippery rayon or metallic thread on home embroidery and sewing machines.

2. Description of the Prior Art

The art of sewing is as old as mankind and goes back more than 20,000 years. The first functional sewing machine in America was invented and patented by Elias Howe. However, it was Isaac Singer who designed and built the first commercially successful sewing machine during the 1850's. Inevitably, the two American inventors fought bitter legal battles resulting with Howe emerging victorious in a court case against Isaac Singer for infringement of the Howe patent.

In spite of having to pay royalties to Howe for the lockstitch concept and application found in sewing machines, Singer built the first sewing machine whereby the needle moved up and down as compared to the Howe side to side concept. Singer also invented the first foot treadle drive method for his sewing machines. Previous primary machines were all hand-crank driven. Singer also went on to patent improved methods for feeding the cloth, regulating the tension on the needle thread, and lubricating the needle thread so that leather could be sewn.

The evolution of the embroidery machine occurred around the beginning of the 19th century which falls within the same time frame as the evolution of the sewing machine. The process of embroidery is the art of stitching decorations on fabric, or similar materials, with a needle and thread. Looking back into the history of hand embroidery discloses that most cultures developed their own methods of embroidery dating back to prehistoric times when all embroidery was done by hand.

Traditionally, craft workers and hobbyists embroider by hand. Today, however, machines do most embroidering of factory products. Single needle home sewing machines can embroider with special attachments for embroidery. Today, home sewing enthusiasts can purchase modem machines with built-in computerized embroidery programs that produce outstanding designs and patterns.

Today the term machine embroidery refers to the use of robotics to affix and move the garment on a frame to sew and embroider desired designs. Modern day digitizing is the process of using customized software to create a computer file that will instruct the embroidery machine how to move, what type of stitch to sew, when to change thread colors and when to knot the end of the threads. Experienced digitizers must first take into account the type of fabric they are sewing and the size and shape of the design they are creating. Finally, each stitch of the design is programmed into the computer of the embroidery machine. If replicating artwork, printed material may be scanned into the computer to create a program that will guide the digitizer to embroider the desired images.

Embroidery Thread Problems

With today's advanced computer technology as applied toward digitizing and the attainment of picture perfect embroidery designs, one would expect the embroidery process to proceed almost totally automatically without interruptions and without the age old problem of thread tangling and breakage. When using rayon thread, however, everyone who embroiders realizes that the perfect scenario simply does not exist.

Instead, practically every embroidery person realizes that the operator must maintain a watchful vigil on a home embroidery and sewing machine or suffer the consequences of constant tangling and breakage when using rayon thread. Each and every time this frustrating dilemma occurs, the operator is required to stop the machine, cut the thread, untangle the snarl and constantly rethread the needle in an attempt to continue and complete each respective sewing/embroidery episode or project.

In addition to said aforementioned inconveniences, the operator is also required to back-space to the area of the garment/material where the stitching and stitches left off before the thread jam and breakage occurred. The purpose of re-doing the last embroidery stitches is due to the fact that many stitches are lost due to said thread breakage problems. The aforementioned back spacing is also required when there is no thread in the needle due to said breakage. Common logic dictates that without thread, no stitches or embroidery patterns can occur.

It is also a fact that most problems encountered and associated with embroidery and tangling, are due to the slick nature of the rayon thread material itself. The slicker and more slippery the material, the more difficult it becomes to prevent the thread from unraveling and sliding off of the reel portion of the thread spool. This frustrating malady, occurs as the machine embroiders and as the thread is being fed and dispensed to the machine from a spool. The same tangling and thread problems are known to exist when using slick metallic embroidery thread.

Another reason for the entanglement and jamming of thread is due to the physical gap spacing that exists between the thread reel spool and the reciprocating take-up lever guide located on the sewing head portion of the home embroidery and sewing machine. The physical weight of the slippery thread itself is sufficient to cause the thread to sag and unravel and thus fall off the spool which accounts for undesirable pooling and piling of thread at the base of said reel/spool.

Furthermore, the physical length and girth of each thread spool varies with each manufacturer which further compounds said thread feeding and tangling problems. Adding to the problems is the fact that all sewing embroidery thread is machine wound onto the spool in a criss-cross manner which requires the thread to unwind in a left/right-up/down manner depending on whether the thread is being fed from the horizontal or optional vertical thread spool pin/rod of the sewing/embroidery machine. It is well known that most thread spools are made without beveled core lips on the spool ends and are known to cause most pooling and tangling problems.

Prior art devices have not adequately solved the problems.

Several types of sewing thread guides have been designed and introduced since the turn of the 20th century. One example of sewing thread guides comprises a plastic guide for threads and yarns extending from the multiple spools to the sewing machine as found in U.S. Pat. No. 4,427,165. Close examination of said patent discloses that the Larsen Thread guide is primarily a device provided with a metal wear-bar for the purpose of preventing thread from cutting a groove in the plastic material of said patented guide. Further review of said device reveals that there is absolutely no mention pertaining to the problems associated with thread unraveling and tangling that occur when using home embroidery and sewing machines nor are any solutions mentioned or disclosed for addressing and remedying the age old problem of tangling experienced by practically every home embroidery enthusiast who uses rayon or metallic thread.

Another type of patented thread guide specifically, U.S. Pat. No. 4,552,321, supports several elongated spool/package positioning members mounted on a creel or spaced horizontal base which is offset or slanted. The multiple spool concept is presently used in several modern day serger machines and is mostly found built-in to various high production embroidery machines where larger capacity thread spools are desirable and necessary. The Raekelboom patent claims a creel for supporting a plurality of yarn packages with inner tapered cores and corresponding longitudinal bores that are not intended for use in home sewing/embroidery machines.

Other attempts at solving the tangling/unraveling problems when using rayon embroidery thread include several carousel types of spool holders. These auxiliary multiple spool holders are mounted on adjacent stands that are placed alongside of a home embroidery and sewing machine. Two of these devices, which are known as the "UNIVERSAL THREAD SPOOL HOLDER®" multiple thread spool holder and the "THREADPRO®" multiple thread spool holder devices, are designed to hold and support from two to six spools of thread simultaneously. However, the operator is still required to thread the machine individually, one spool at a time, for each and every thread color change when working with either of the two aforementioned carousel type devises. Further study reveals that several carousel manufacturers offer for sale an array of thread spool cone holders and thread nets in a futile attempt to address and deal with the familiar problem of unraveling and tangling when using slippery rayon thread. To the dismay of embroidery fans throughout the world, the continuing tangling problems have not been solved nor eliminated by the prior art.

Accordingly, there is a need for an improved embroidery thread guide means for providing and assuring positive and tangle-free thread feeding of thread and for assisting in keeping consistent thread tension while using various types of thread materials and spools designated for home embroidery and sewing machines. The new device should also be adjustable with regards to left/right up/down positioning of the guide eye to ascertain center area positioning of said guide eye which is located on a free-standing slidable wire support arm of the preferred embodiment of the present invention. When adjustments are desired and made in the guide prior to doing home embroidery and sewing machine work, said adjustments should be easily made, be reproducible and should stay in place during any and all short or extensive embroidery runs or projects. Such criteria have not been met with other conventional thread guides or prior art. Accordingly, it would be desirable to provide an improved thread guide capable of being releaseably attached to the home embroidery and sewing machine and one that is adapted for remaining attached to said sewing/embroidery machine if desired.

Such criteria has not been met with conventional or prior art thread guides.

SUMMARY OF THE INVENTION

The improved thread guide of the present invention satisfies all the foregoing needs. The new guide solves the problem of pooling and tangling of thread by providing consistent feeding of thread from the mid central area of a thread spool by means of an adjustable and slideable thread guide eye. Said guide eye is fastened to a base mount that is releaseably attachable to a home embroidery and sewing machine spool pin rod.

The thread guide comprises one which has the following components:

(a) a means for attaching the guide to the spool pin rod(s) of a home embroidery and sewing machine. Such means preferably includes the following:

(1) a base mount with a hole in the center for the purpose of releaseably securing the thread guide to said home embroidery and sewing machine.

(2) said attachment feature is achieved by means of a molded press-fit expandable cross-cut neck bell on said base mount that grips and secures the thread guide unit to the spool pin rod of a sewing/embroidery machine for the purpose of accommodating varying dimensional differences of spool pin rods by various home embroidery and sewing machine manufacturers. Another purpose of said gripping action is to permit vibration free feeding of thread without undue clatter or hesitation of the guide unit.

(b) a free standing upwardly projecting laterally adjustable thread guide wire with an improved elliptically shaped eye on one end for the purpose of providing easy thread loading and tangle-free feeding of thread and a press-fit arrangement of coil windings on the lower/opposite end of said guide wire for the purpose of slideably gripping the transverse projecting slotted adjustment rod of the preferred embodiment. Said left/right adjustments are necessary to ascertain that the guide wire eye is centrally located and positioned for the purpose of feeding thread from the mid central area of said thread spool(s) to the consuming machine without tangling or pooling of the embroidery thread.

The basic simple version is comprised of a base-mount and a bendable wire or flexible memory material thread guide fitted with a pigtail or thread guide eye on one end for easy thread loading and smooth dispensing of embroidery thread. Preferably, the guide wire is "L" shaped and is affixed to a base mount while projecting either straight across from said base or angled upwardly for the purpose of allowing and making wire bend adjustments of the thread guide eye. The purpose for the preferred positioning of the guide eye is to control and funnel the embroidery thread material so that the thread feeds continually from the central mid-point area of the thread spool to the consuming machine.

To facilitate and speed up the threading process on a sewing/embroidery machine, the embroidery thread guide of the present invention has a loop shaped pig-tail shaped eye on one end of the guide wire. The most dissimilar and striking differences of the preset invention over any prior art is the method of attaching and mounting the thread guide onto a home embroidery and sewing machine utilizing the machine spool pin rod along with the novel central positioning of the guide eye mentioned and described in the preceding paragraph. The purpose of the spool pin rod attachment procedure is to affix the thread guide to said machine for the purpose of assuring absolute and constant feeding of embroidery thread via the guide eye from the central mid-point area of the supply spool to the consuming machine. This application positively prevents and eliminates any and all pooling or tangling of thread on all home embroidery and sewing machines regardless of thread spool designs utilized.

Simultaneously, the new thread guide shortens the length of span and spacing that exists between the thread spool and the external or internal take-up lever of a machine. This application and procedure also serves to introduce and apply the element of friction to the thread line by the calculated placement of the guide eye within close proximity of the dispensing thread spool which creates and applies a small amount of increased line drag and friction to the slippery embroidery thread as it leaves the spool to feed the consuming embroidery machine.

A general explanation and comparison would be taking a dog for a walk using a lengthy leash whereby the dog can trip, wind itself around a pole or trip the owner with the lengthy leash. On the other hand, a dog owner with a short leash has improved control over his animal by the advantage of the shorter leash and the accompanying reduced leash slack.

Without using the new invention, the slippery rayon embroidery thread starts to unravel the instant the end of the thread is released and set free as the operator starts to thread and load the machine.

The base support for the guide wire is preferably configured as a stair-step base support to accommodate various thread spool core sizes and to stabilize the spool of thread so that it does not vibrate and thus induce a jerking action upon the feeding of the thread from the spool. The stair-step structure can be molded onto the base portion of the device or can also be a separate molded step tier piece whereby the base portion is first installed and affixed to the spool pin followed by the preferably 3-step tier piece. A clamping locking feature similar to the one found in the underside of the base-mount body unit can also be molded onto the upper portion of the 3-step tier piece for the purpose of seating and accommodating the various thread spool core sizes while also serving as a lockdown means for anchoring and securing the thread guide device during vertical use which refers to spool pin orientation and application.

For using a horizontal spool pin application, the separate staircase feature is not necessary due to the fact that most machined horizontal spool pins are slightly larger in diameter. However, the alternate standard and commercial locking accessory is recommended to assure positive lockdown of the base mount unit.

The wire guide pigtail positioning is non critical as long as it is placed and positioned so that the guide eye sits adjacent to and in the general central vicinity of the dispensing thread spool.

BRIEF DESCRIPTION OF THE DRAWINGS

These and other details of my invention will be described in connection with the accompanying drawings, which are furnished only by way of illustration and not in limitation of the invention, and in which drawings:

FIG. 5A is a partial perspective view of the underside of the base support;

BEST MODE FOR CARRYING OUT THE INVENTION

Figure 1:
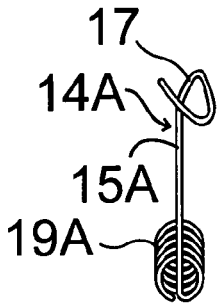
FIG. 1 is a front perspective view of the wire embroidery thread guide of the present invention.

In FIGS. 1–10, a thread guide attachable to an embroidery and sewing machine spool pin rod 11 comprises a thread guide arm 14A–14C attached by a base mount 20 for guiding embroidery thread 16 from an embroidery spool 12 on the spool pin rod 11 of an embroidery and sewing machine 10.

Figure 3:
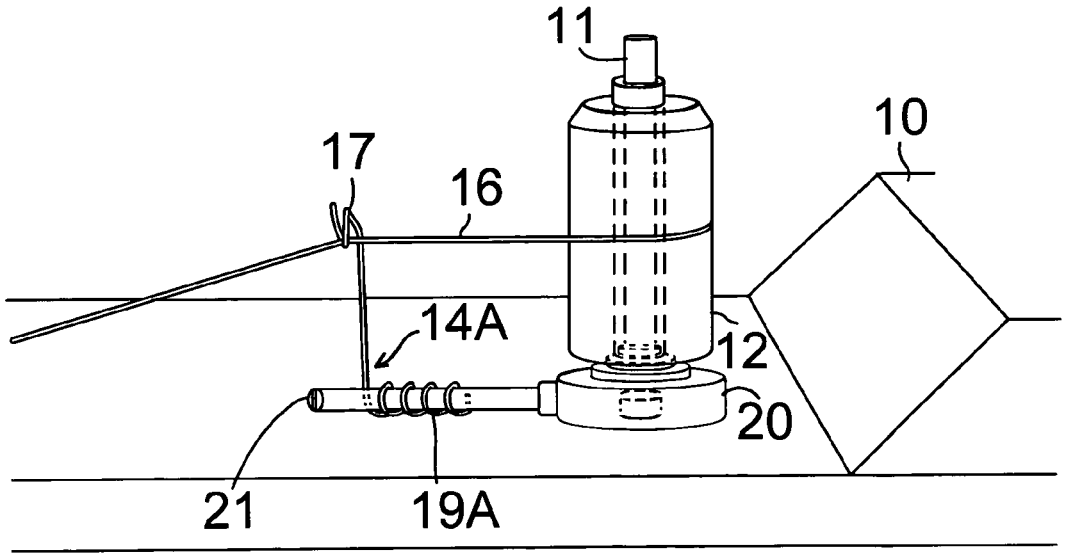
FIG. 3 is a side perspective view of the thread guide of FIG. 1 mounted on the arm of the base support of FIG. 2 mounted on a sewing and embroidering machine.
Figure 5:
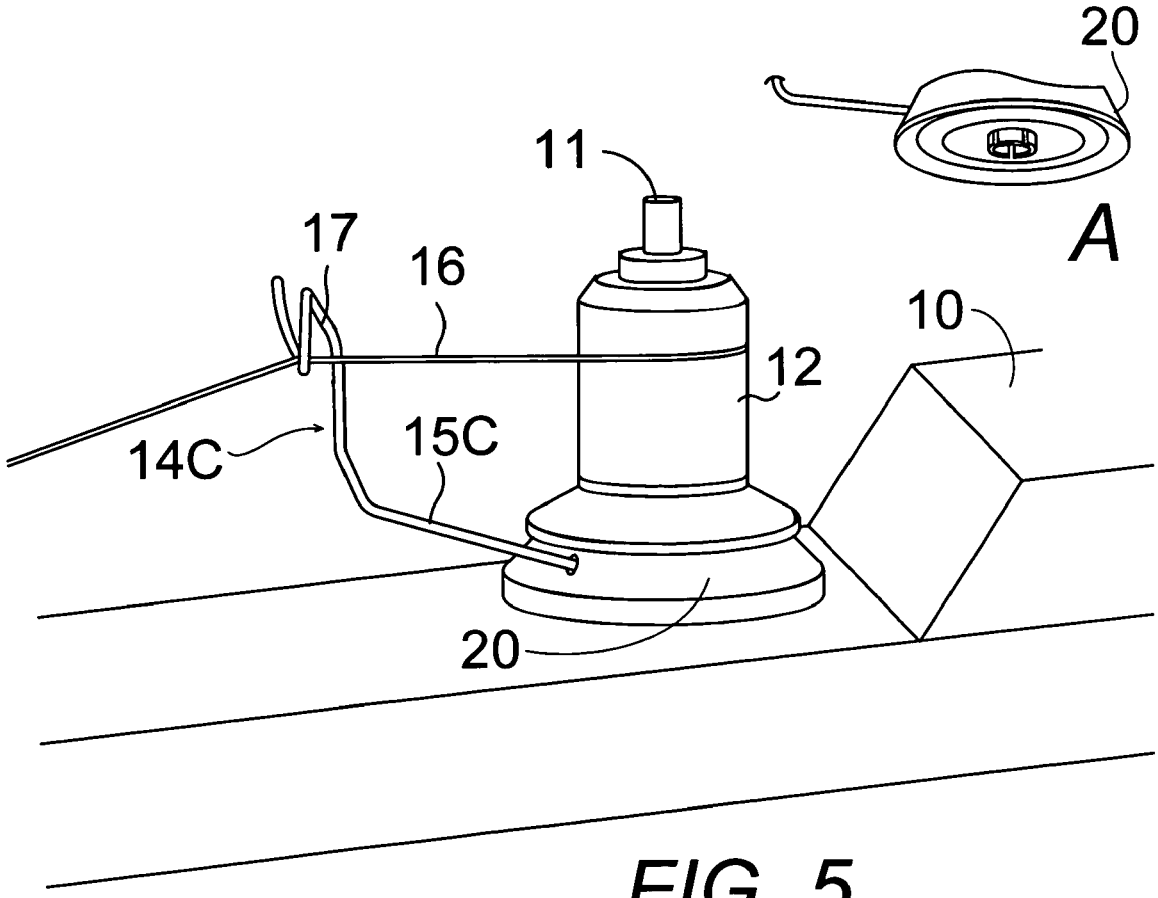
FIG. 5 is a side perspective view of a thread guide mounted directly on a spool base support with no adjusting arm or stair-step structure and with the base support mounted on a sewing embroidering machine.
Figure 6:
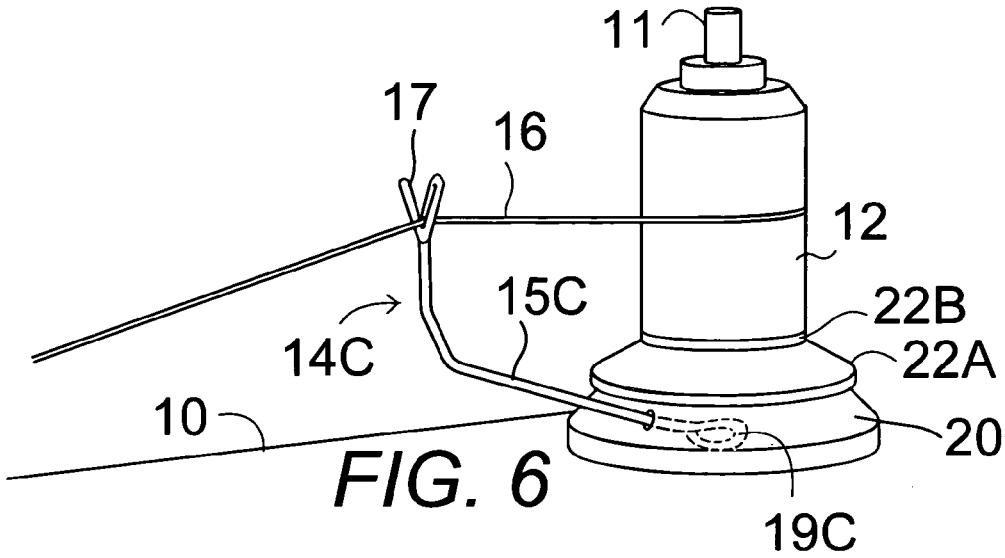
FIG. 6 is a perspective view of a sloping stepped base support with an embroidery thread guide mounted directly on the base support showing the base support mounted on a sewing and embroidering machine with a spool of embroidery thread mounted thereon and the embroidery thread threaded through the guide loop.

The thread guide arm 14A–14C comprises an upwardly projecting element, preferably a bent wire 15A–15C with an open loop 17, preferably an open spiral bend, at a distal end of the bent wire. The thread guide arm is adapted to generally extend along a forward-rearward axis of an embroidery and sewing machine 16 with the open loop spaced apart from and positioned opposite to a central portion of an embroidery thread spool 12 of an embroidery and sewing machine 10, as seen in FIGS. 3, 5, and 6. The open loop 17 is adapted to receive a line of embroidery thread 16 through the open loop 17 with the line of embroidery thread 16 extending from the embroidery thread spool 12 on one side of the thread guide arm through the open loop 17 to a needle assembly (not shown) on an opposite side of the thread guide arm, so that the thread guide maintains the line of embroidery thread in an elevated position and creates an added tension between the thread guide arm 14A–14C and the embroidery thread spool 12 thereby providing consistent feeding of the line of embroidery thread 16 from a central portion of the embroidery thread spool to prevent pooling and tangling of the line of embroidery thread.

The open spiral bend forming the open loop 17 is adapted to receive a line of embroidery thread slipped into the open spiral bend and retained slidably therein.

Figure 2:
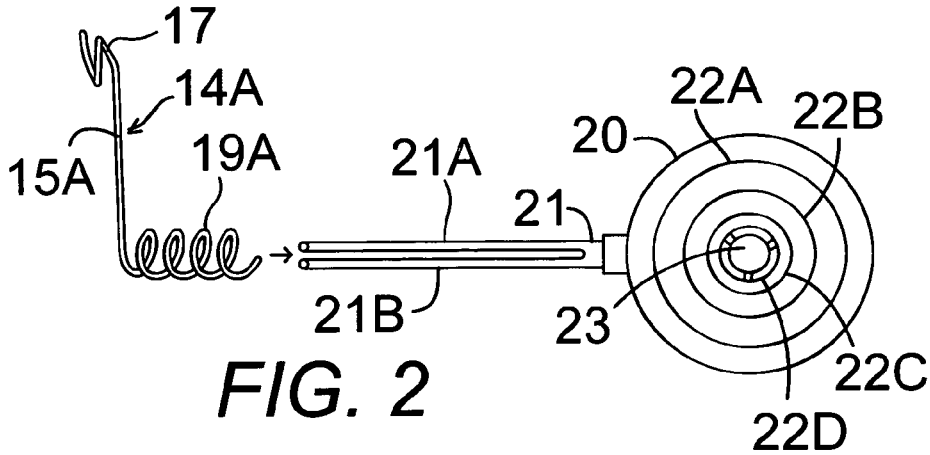
FIG. 2 is a top elevational view of a base support for the spool and thread guide with a laterally extending arm to receive the thread guide of FIG. 1, which thread guide is shown in a side view aligned for mounting on the arm, to enable adjustable positioning of the thread receiving loop from the embroidery thread spool.

The means for attaching the thread guide to the embroidery spool pin 11 comprises a base mount 20 with a base mount hole 23 through a center of the base mount, as seen in FIG. 2. The base mount hole 23 is adapted to receive the embroidery thread spool pin rod 11 therethrough and a tapered slotted neck bell 22D, located on the underside of said mount as seen in FIG. 2, for clamping onto the embroidery thread spool pin rod 11 and positioned on one side of the base mount hole 23. The slotted neck bell 22D is adapted for expanding or contracting to grip the embroidery thread spool pin rod 11 and releasably secure the thread guide to the embroidery thread spool pin rod.

In FIGS. 1–4, a means for attaching the thread guide to the base mount comprises an arm 21 extending from the base mount 20 and the thread guide arm further comprises a bent coil configuration 19A on a proximal end of the thread guide arm 14A, the bent coil configuration adapted to fit slidably and removably on the rigid arm 21 with a friction fit. The arm 21 preferably comprises a slotted transverse rod 21 having at least two spaced arms 21A and 21B, whereby the slotted transverse rod 21 and the bent coil configuration 19A comprise a friction fit for slidably adjusting and moving the slotted loop toward and away from the base mount 20 thereby adjusting the distance of the thread guide arm 14A and the embroidery thread spool 12.

Figure 4:
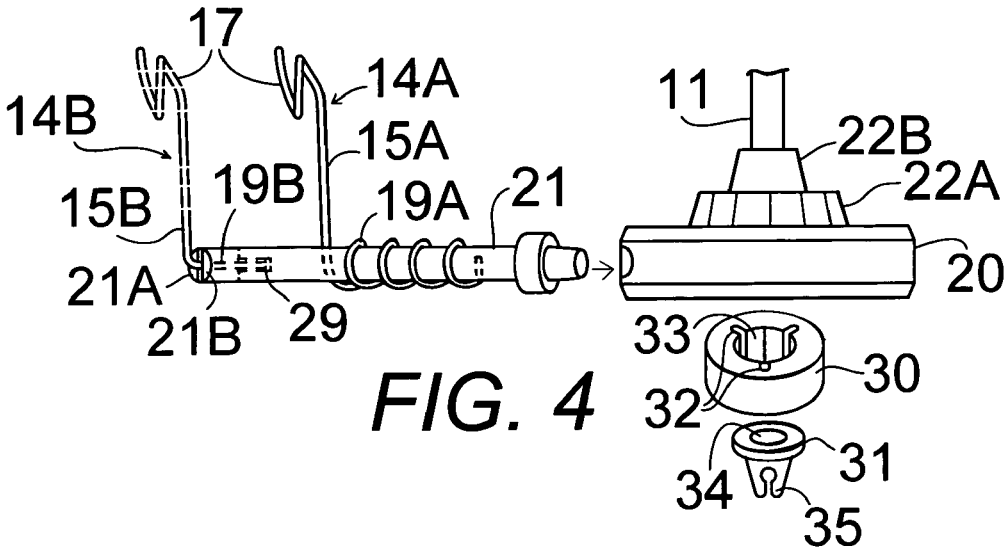
FIG. 4 is a side perspective view showing the base support, arm, and thread guide components aligned for mounting and the base support mounting elements aligned for mounting showing alternative thread guide lockdown means.

In FIG. 4, an alternate means for attaching the thread guide arm 14B to the slotted transverse rod 21 comprises a straight proximal end 19B (shown dashed) of the thread guide arm inserted in an internal longitudinal opening 29 (shown dashed) inside the slotted transverse rod 21. The sidewalls of arms 21A, 21B, intended to sandwich and contain the thread guide wire 17 in an upright position as shown in FIG. 4. Alternate spool holders 30–35 can be used along with the new thread guide, in horizontal use, in the event that the slotted neck bell fails to grab and hold onto the spool pin rod. This occurs when the spool pin rod is too small in diameter. A much simpler and less expensive approach and solution would be to use a spool seat sponge holder which is a die-cut elastic washer made from rubber sponge material, sometimes covered with fabric. Any sponge or elastic washer, with a small reduced hole opening in the center, will work for gripping and holding onto the horizontal spool pin rod.

FIG. 6, shows a means for molding the thread guide arm 14C to the base mount 20 whereby the thread guide wire 17 rises to meet and support the thread 16, and the thread guide arm further comprises a circular bend loop 19C (shown dashed) in a proximal end of the thread guide arm, the circular bend loop adapted to be molded thus anchoring the thread guide wire 17 to the base mount 20 permanently.

Figure 7A:
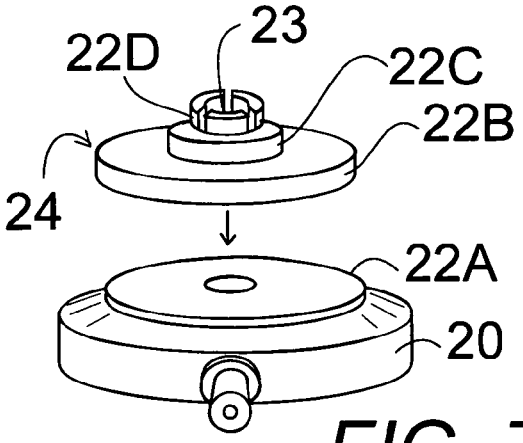
FIG. 7A is a front exploded perspective view of a stepped attachment aligned to be installed on a base support and spool pin rod.
Figure 7B:
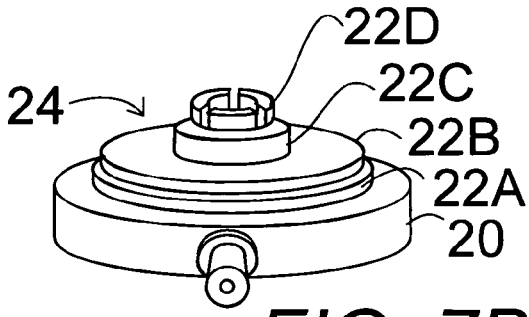
FIG. 7B is a front perspective view of a stepped attachment shown resting on top of a base support.
Figure 8:
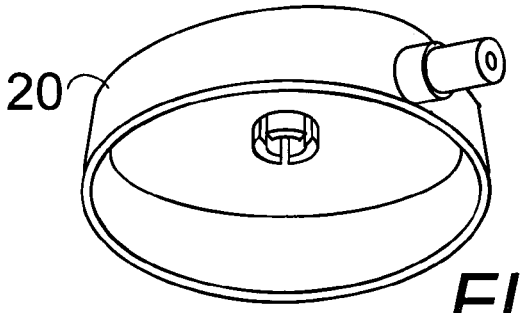
FIG. 8 is a perspective view of a bottom of a base support.

The base mount 20 preferably comprises a circular pedestal adapted to receive an embroidery thread spool 12 resting rotatably thereon. A series of stepped circular pedestals 22A–22D of various diameters on the base mount are adapted to receive any of a variety of sizes of embroidery thread spools 12 resting rotatably thereon. The series of stepped circular pedestals may be formed as an integral part of the base mount 20, as shown in FIGS. 2, 4, 5, and 6 or the series of stepped circular pedestals 22B–22D may be formed as a separate stepped pedestal unit 24, is seen in FIGS. 7A and 7B mounted on top of the base mount 20. The separate stepped pedestal unit 24 is provided with a pedestal unit hole 23 through a center of the pedestal unit adapted to receive an embroidery thread spool pin rod 11 therethrough, and an undersized pedestal unit slotted neck bell 22D smaller than an embroidery thread spool pin rod on one side of the pedestal unit hole, the pedestal unit slotted neck bell 22D adapted for expanding or contracting to grip an embroidery thread spool pin rod 11 and releasably secure the pedestal unit to an embroidery thread spool pin rod of an embroidery and sewing machine.

Figure 9:
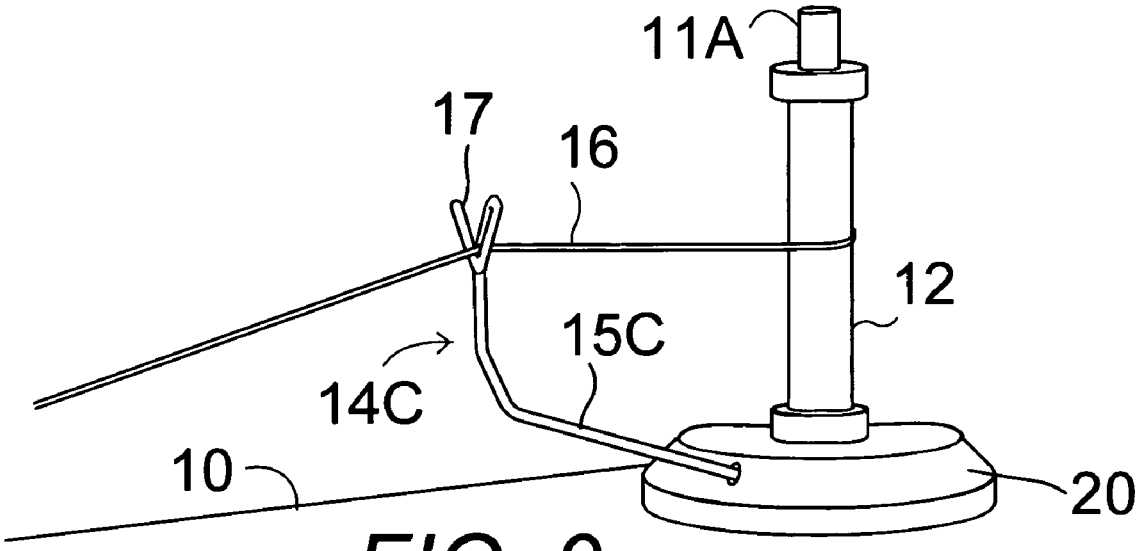
FIG. 9 is a side perspective view of the thread guide of FIG. 5 shown with a small size spool of embroidery thread mounted on a vertical spool pin rod of a sewing embroidery machine.

In FIG. 9, a small size spool 12 of embroidery thread is mounted on a vertical spool pin rod 11A of a sewing embroidery machine 10 with the base mount 20 mounted parallel to the ground around the base of the rod.

Figure 10:
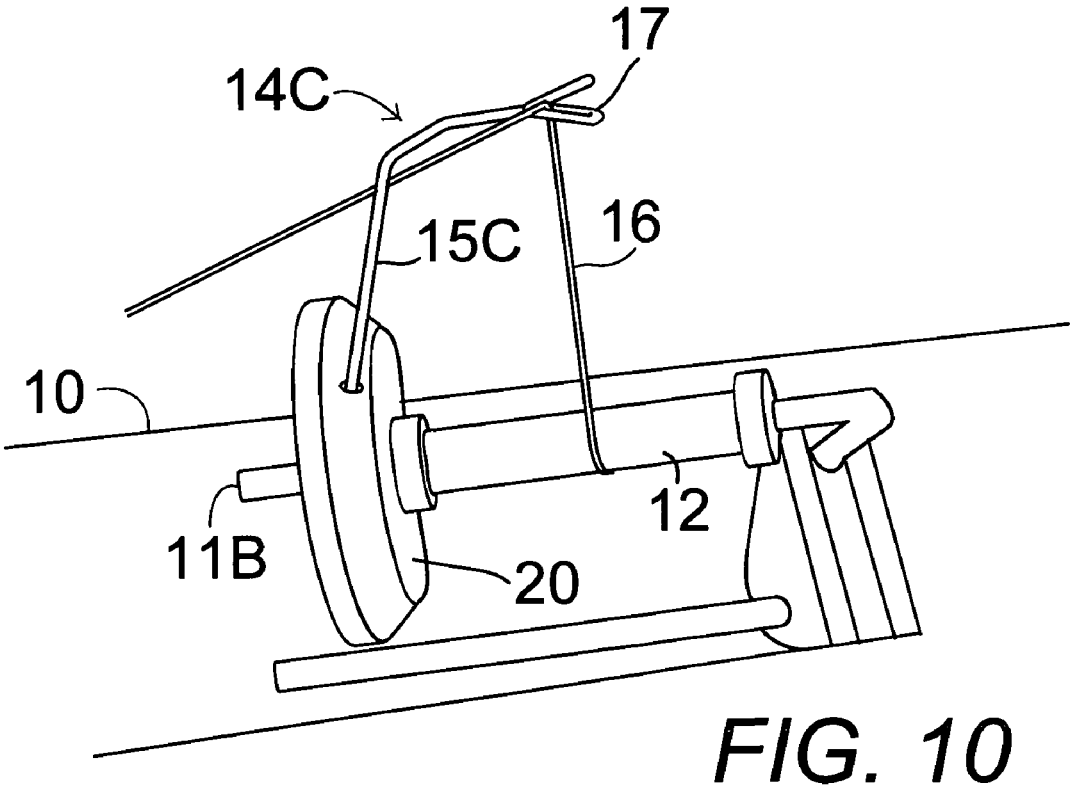
FIG. 10 is a side perspective view of the thread guide of FIGS. 5 and 9 also showing a small thread spool mounted on one of two horizontal spool pin rods of a popular brand sewing embroidery machine.

In FIG. 10, a small thread spool 12 of embroidery thread is mounted on one of two horizontal spool pin rods 11B of a popular brand sewing embroidery machine 10 with the base mount 20 mounted perpendicular to the ground around the end of the rod.

The embroidery thread guide of the present invention may be applied to existing embroidery and sewing machines or fabricated as a part of an improved embroidery and sewing machine comprising in combination, wherein the embroidery and sewing machine 10 is equipped with an embroidery thread spool pin rod 11, the embroidery and sewing machine being adapted for producing various embroidery designs and stitch techniques on material.

The novel thread guide of the present invention may be made from any smooth, slick, durable material including metal, plastic, nylon, and fiberglass.

It is understood that the preceding description is given merely by way of illustration and not in limitation of the invention and that various modifications may be made thereto without departing from the spirit of the invention as claimed.

What is claimed is:

1. A thread guide attachable to an embroidery and sewing machine spool pin rod, the thread guide comprising:

a thread guide arm comprising an upwardly projecting element with an open loop on one end, the thread guide arm adapted to generally extend along a forward-rearward axis of an embroidery and sewing machine with the open loop spaced apart from and positioned opposite to a central portion of an embroidery thread spool of an embroidery and sewing machine between two ends of the embroidery thread spool in line with a release of an embroidery thread with the embroidery thread in a perpendicular alignment with a longitudinal axis of the embroidery thread spool, the open loop adapted to receive a line of embroidery thread through the open loop with the line of embroidery thread extending from an embroidery thread spool mounted on an embroidery and sewing machine on one side of the thread guide arm through the open loop, followed by the normal machine threading procedure, and onto a needle assembly on an opposite side of the thread guide arm, so that the thread guide maintains a line of embroidery thread in an elevated position with the line of embroidery thread extending perpendicularly from the longitudinal axis of the embroidery thread spool and creates an added tension between the thread guide arm and an embroidery thread spool thereby providing consistent feeding of the line of embroidery thread from the embroidery thread spool to prevent pooling and tangling of a line of embroidery thread;

a means for attaching the thread guide to a spool pin rod of an embroidery and sewing machine at a base of the embroidery thread spool so that the thread guide arm extends perpendicularly away from a longitudinal axis of the embroidery thread spool.

2. The thread guide of claim 1 wherein the thread guide arm comprises a bent wire and the open loop comprises an open spiral bend at a distal end of the bent wire, the open spiral bend adapted to receive a line of embroidery thread slipped into the open spiral bend and retained slidably therein.

3. The thread guide of claim 2 wherein the means for attaching the thread guide comprises a base mount with a base mount hole through a center of the base mount, the base mount hole adapted to receive an embroidery thread spool pin rod therethrough and a tapered slotted neck bell for clamping onto the embroidery thread spool pin rod by means of the tips of the resulting prongs located on one side of the base mount hole, the slotted neck bell adapted for expanding or contracting to grip an embroidery thread spool pin rod and releasably secure the thread guide to an embroidery thread spool pin rod of an embroidery and sewing machine and a means for attaching the thread guide arm to the base mount.

4. The thread guide of claim 3 wherein the means for molding the thread guide arm to the base mount includes a circular bend loop in a proximal end of the thread guide arm, for the purpose of permanently anchoring and securing the guide wire to said base mount.

5. The thread guide of claim 3 wherein the means for attaching the thread guide to the base mount comprises an arm extending from the base mount and the thread guide arm further comprises a bent coil configuration on a proximal end of the thread guide arm, the bent coil configuration adapted to fit slidably and removably on the rigid arm with a friction fit.

6. The thread guide of claim 5 wherein the arm comprises a slotted transverse rod having at least two spaced arms to receive the thread guide wire and the bent coil configuration for slidably adjusting and moving the slotted loop toward and away from the base mount.

7. The thread guide of claim 3 wherein means for attaching the thread guide arm to the base mount comprises an arm extending from the base mount, the arm having an internal longitudinal opening, and the thread guide arm further comprises a straight proximal end adapted to be inserted in the internal longitudinal opening.

8. The thread guide of claim 3 wherein the base mount comprises a circular pedestal adapted to receive an embroidery thread spool resting rotatably thereon.

9. The thread guide of claim 8 wherein the base mount further comprises a series of stepped circular pedestals of various diameters adapted to receive any of a variety of sizes of embroidery thread spools resting rotatably thereon.

10. The thread guide of claim 9 wherein the series of stepped circular pedestals are formed as an integral part of the base mount.

11. The thread guide of claim 9 wherein the series of stepped circular pedestals are formed as a separate stepped pedestal unit mounted on top of the base mount, and the separate stepped pedestal unit is provided with a pedestal unit hole through a center of the pedestal unit, the pedestal unit hole adapted to receive an embroidery thread spool pin rod therethrough, and a tapered pedestal unit slotted neck bell for clamping onto an embroidery thread spool pin rod on one side of the pedestal unit hole, the pedestal unit slotted neck bell adapted for expanding or contracting to grip an embroidery thread spool pin rod and releasably secure the pedestal unit to an embroidery thread spool pin rod of an embroidery and sewing machine.

12. An improved embroidery and sewing machine comprising in combination:

an embroidery and sewing machine equipped with one or more embroidery thread spool pin rods, the embroidery and sewing machine adapted for producing various embroidery designs and stitch techniques on material;

an improved thread guide assembly releasably attached to the embroidery thread spool pin rod, the thread guide assembly comprising a base mount releasably attached to the embroidery thread spool pin rod at a base of the embroidery thread spool, at least one thread guide arm extending from the base mount, with at least one thread guide arm generally extending along a forward-rearward axis of the embroidery and sewing machine so that the at least one thread guide arm extends perpendicularly away from a longitudinal axis of the embroidery thread spool, and at least one thread guide arm comprising an open loop adjacent to an upper end thereof, the open loop adapted to be spaced apart from and positioned opposite to a central portion of an embroidery thread spool on the embroidery thread spool pin rod between two ends of the embroidery thread spool in line with a release of an embroidery thread with the embroidery thread in a perpendicular alignment with a longitudinal axis of the embroidery thread spool, the open loop adapted to receive a line of embroidery thread through the open loop with the line of embroidery thread extending from the embroidery thread spool on one side of the thread guide arm through the open loop to the machine take-up lever and onto a needle assembly on an opposite side of the thread guide arm, so that the thread guide arm maintains a line of embroidery thread in an elevated position with the line of embroidery thread extending perpendicularly from the longitudinal axis of the embroidery thread spool and creates an added tension between the thread guide arm and an embroidery thread spool thereby providing consistent feeding of a line of embroidery thread from a central portion of an embroidery thread spool to prevent pooling and tangling of a line of embroidery thread.

13. The thread guide of claim 12 wherein the thread guide arm comprises a bent wire and the open loop comprises an open spiral bend at a distal end of the bent wire, the open spiral bend adapted to receive a line of embroidery thread slipped into the open spiral bend and retained slidably therein.

14. The thread guide of claim 13 wherein the base mount is provided with a base mount hole through a center of the base mount, the base mount hole adapted to receive an embroidery thread spool pin rod therethrough and a tapered slotted neck bell for clamping onto an embroidery thread spool pin rod on one side of the base mount hole, the slotted neck bell adapted for expanding or contracting to grip the embroidery thread spool pin rod and releasably secure the thread guide to the embroidery thread spool pin rod and further comprising a means for attaching the thread guide arm to the base mount.

15. The thread guide of claim 14 wherein the means for molding the thread guide arm to the base mount comprises a circular bend loop in a proximal end of the thread guide arm for the purpose of integrating the thread guide wire within the base mount.

16. The thread guide of claim 14 wherein the means for attaching the thread guide to the base mount comprises an arm extending from the base mount and the thread guide arm further comprises a bent coil configuration on a proximal end of the thread guide arm, the bent coil configuration adapted to fit slidably and removably on the rigid arm with a friction fit.

17. The thread guide of claim 16 wherein the arm comprises a slotted transverse rod having at least two spaced arms, the slotted transverse rod adapted to receive the thread guide wire and the bent coil configuration for slidably adjusting and moving the slotted loop toward and away from the base mount.

18. The thread guide of claim 14 wherein means for attaching the thread guide arm to the base mount comprises an arm extending from the base mount, the arm having an internal longitudinal opening, and the thread guide arm further comprises a straight proximal end adapted to be inserted in the internal longitudinal opening.

19. The thread guide of claim 14 wherein the base mount comprises a circular pedestal adapted to receive an embroidery thread spool resting rotatably thereon.

20. The thread guide of claim 19 wherein the base mount further comprises a series of stepped circular pedestals of various diameters adapted to receive any of a variety of sizes of embroidery thread spools resting rotatably thereon.

21. The thread guide of claim 20 wherein the series of stepped circular pedestals are formed as an integral part of the base mount.

22. The thread guide of claim 20 wherein the series of stepped circular pedestals are formed as a separate stepped pedestal unit mounted on top of the base mount, and the separate stepped pedestal unit is provided with a pedestal unit hole through a center of the pedestal unit, the pedestal unit hole adapted to receive an embroidery thread spool pin rod therethrough, and a tapered pedestal unit slotted neck bell, the slotted neck bell adapted for expanding or contracting to grip an embroidery thread spool pin rod and releasably secure the pedestal unit to an embroidery thread spool pin rod of an embroidery and sewing machine.

23. The thread guide of claim 1 wherein the thread guide is fabricated from a smooth, slick, durable material taken from the list of smooth, thick, durable materials including metal, plastic, nylon, and fiberglass.

* * * * *